US007952729B2

(12) United States Patent
de la Riva et al.

(10) Patent No.: US 7,952,729 B2
(45) Date of Patent: May 31, 2011

(54) MEASURING INSTRUMENT FOR DETERMINING THE ACTUAL CONDITION OF WHEEL SETS

(75) Inventors: Camilo de la Riva, Grevenbroich (DE); Dieter Rosenland, Wegberg (DE); Norbert Braun, Roetgen (DE); Theo Nijssen, CJ Beesel (NL)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 291 days.

(21) Appl. No.: 12/302,179

(22) PCT Filed: May 22, 2007

(86) PCT No.: PCT/EP2007/054969
§ 371 (c)(1),
(2), (4) Date: Mar. 16, 2009

(87) PCT Pub. No.: WO2007/135159
PCT Pub. Date: Nov. 29, 2007

(65) Prior Publication Data

US 2009/0168078 A1 Jul. 2, 2009

(30) Foreign Application Priority Data

May 23, 2006 (DE) ..... 10 2006 024 040

(51) Int. Cl.
*G01B 11/14* (2006.01)

(52) U.S. Cl. ..... 356/614; 356/615

(58) Field of Classification Search ..... 356/620–623, 356/601–604, 612–615, 3.01, 635; 250/224, 250/559.22–559.24, 200, 216, 221, 222.1, 250/559.01, 559.19
See application file for complete search history.

(56) References Cited

U.S. PATENT DOCUMENTS

| | | | | |
|---|---|---|---|---|
| 4,798,964 | A | 1/1989 | Schmalfuss et al. | 250/560 |
| 5,636,026 | A | 6/1997 | Mian et al. | 356/376 |
| 5,793,492 | A | 8/1998 | Vanaki | 356/376 |
| 2003/0072001 | A1 | 4/2003 | Mian et al. | 356/446 |
| 2006/0232787 | A1 | 10/2006 | Hoffmann et al. | 356/602 |

FOREIGN PATENT DOCUMENTS

EP 0 228 500 B2 3/1986

(Continued)

OTHER PUBLICATIONS

International Search Report for International Application No. PCT/EP2007/054969.

(Continued)

*Primary Examiner* — Gregory J Toatley
*Assistant Examiner* — Tri T Ton
(74) *Attorney, Agent, or Firm* — Proskauer Rose LLP

(57) ABSTRACT

A measuring instrument has a first section for rolling a wheelset under lateral guidance of the wheelset into a measurement section with an auxiliary rail for supporting the wheelset on the outer edges of its wheels and a third section for rolling out the wheelset into the railway track, with the first and third section of the measuring instrument also designed as track panels and for which the optical beam devices under the measurement section are intended. The first and third section of the measuring instrument are flexibly embedded in the ballast of the superstructure of the railway track, while at least one of the optical beam devices is mounted vibration-free on the formation of the railway track in a pre-determined position in relation to the measurement section of the measuring instrument with no contact to the other parts of the measuring instrument.

11 Claims, 4 Drawing Sheets

FOREIGN PATENT DOCUMENTS

| | | |
|---|---|---|
| WO | 2004/008067 | 1/2004 |
| WO | 2004/085957 | 10/2004 |

OTHER PUBLICATIONS

Hoffmann, Dieter: *Wheel Profile Wear Test on Passing Railway Vehicles* ("Hoffmann") Please note that the "Hoffman" publication includes an English summary in the second to last paragraph of the reference. Please also note the concise explanation of the "Hoffman" publication included in the information disclosure statement filed herewith.

Hauschild, G.; Neumann, P.: *Automatic Diagnosis of the Condition or Railway Wheels with the ARGUS System, in ZEV & DET Glas. Ann. 124* (2000), Dec. 12 ("Hauschild") Please note the the "Hauschild" publication includes as a first paragraph an English summary of the content of the reference. Please also note the concise explanation of the "Hauschild" publication included in the information disclosure statement filed herewith.

MEASURING INSTRUMENT FOR DETERMINING THE ACTUAL CONDITION OF WHEEL SETS

CROSS-REFERENCE TO RELATED APPLICATIONS

This application is a National Phase Application of International Application No. PCT/EP2007/054969, filed on May 22, 2007, which claims the benefit of and priority to German patent application no. DE 10 2006 024 040.5-24, filed May 23, 2006. The disclosure of the above applications are incorporated herein by reference in their entirety.

FIELD OF THE INVENTION

The invention concerns a measuring instrument, positioned in the track panel of a railway track, for determining the actual condition of wheelsets and wheels of a railway vehicle passing by using several optical beam devices. The measuring instrument has a first section for rolling in a wheelset under lateral guidance of the wheelset, a measurement section with an auxiliary rail for supporting the wheelset on the outer edges of its two wheels and a third section for rolling out the wheelset into the railway track. The first and third section of the measuring instrument are also designed as track panels and the optical beam devices of the system are positioned under the measurement section.

BACKGROUND

Measurement systems of this type are known, for example, from:

1. Hoffmann, Dieter: "Wheel Profile Wear Test on Passing Railway Vehicles".
2. EP0 228 500 B2
3. Hauschild G./Neumann P.: "Automatic Diagnosis of the Condition of Railway Wheels with the ARGUS System" in ZEV+DET Glas. Ann. 124 (2000), 12th December.
4. WO 2004/085957 A1

D1: U.S. Pat. No. 5,793,492
D2: WO 2004/008067
D3: US 2003/072001A1
D4: U.S. Pat. No. 5,636,026

In this context, WO 2004/085957 A1 refers to a solid body (1) on which the measuring instrument is positioned. The document D4: U.S. Pat. No. 5,636,026 stipulates a "solid steel plate (12)" used to connect the measuring instruments firmly to the through track, with the through track also designed as track panel.

The known standard of technology requires heavy-weight supports to avoid relative movements between the measuring devices and prevent the through track from bending under the weight of the railway vehicle passing over it. The measuring instrument and the through track are usually positioned on a heavy concrete foundation. The costs for such a concrete foundation are high and sometimes equal half the value of the entire measuring system.

With other known solutions for this standard of technology, the measuring instruments are connected to the measurement section of the track to avoid heavy foundations. Due to such a connection, the measuring instrument follows the bending of the track under the load of the railway vehicle rolling over it. There is no relative movement between the track and the measuring instrument in the process.

For example, the document D2: WO 2004/008067 stipulates that the measuring instruments should be positioned in a trough and the trough fastened under the track with plates. The individual measuring devices of the measuring instrument are mounted on flexible dampers in the trough. A cover plate with openings for light sources and cameras prevents anything from falling into the trough from above, while an air curtain protects the optical windows or lenses from dust, small objects and leaves.

Another document D3: US 2003/072001 A1 stipulates the arrangement of optical beam devices on plates, each assigned to a rail of the track and firmly connect to it. The optical beam devices are each aligned at a close vertical distance to the measurement object, the railway wheel. However, the insufficient vertical distance causes inaccuracies during measurements, in particular when measuring the diameter and profile.

The disadvantage of an insufficient vertical distance between the measuring devices and the measurement object also applies to a solution which is known from document D1: U.S. Pat. No. 5,793,492. In this case the optical beam devices are each accommodated in housings mounted on thick steel plates. The steel plates (three are named) rest on dampers, regardless of the track, i.e. rails and thresholds. As a result, the measuring instruments are not effected by the track bending, however their attachment to several thick steel plates and the noticeable short distance between the measuring instruments and the measurement object increase the computation volume, which is a distinguishing factor of the D1 document.

SUMMARY OF THE INVENTION

In general, an aspect of the invention is to avoid expensive foundations or attachment devices in order to simplify the measuring system and reduce its price.

Based on the fact that relative movements between the measuring devices and the through track of up to 25 mm can be handled by optical beam devices, the invention is designed for decoupling the measuring instruments from the through track. As a result, the first and third section of the measuring instrument are flexibly embedded in the ballast of the railway track superstructure, while the optical beam devices used to determine the actual condition of the wheelset or wheels of the railway vehicle are mounted vibration-free on the formation of the railway track in a pre-determined position in relation to the measurement section of the measuring instrument with no contact to the other parts of the measuring instrument. It is therefore no longer necessary to manufacture expensive foundations or other solid devices required to connect the measuring instruments to the through track.

In an embodiment, the optical beam devices are mounted on a layer of lightweight concrete which is thinner than the remaining layer of the ballast of the railway track superstructure. Another advantage is achieved by mounting the optical beam devices on a base plate. Such a base plate can then be designed in the shape of a trough, circumferentially surrounded by lateral walls. This trough stretches across the entire width of the railway track, depending on the respective track gauge. The trough is intended to accommodate all optical beam devices of the measuring instrument. Two of these optical beam devices are intended for determining the WD dimension of a railway wheel (WD=distance between the wheels). Two further optical beam devices are intended for determining each of the profiles of the cross-section of the two wheels of a wheelset of a railway vehicle. Two further optical beam devices are used to determine each of the diameters of the two wheels of a wheelset along the section of a specified first circumference line of the wheels. Two further optical beam devices are used to determine the diameters of the two wheels of a wheelset along the section of a specified second circumference line of the wheels with the second circumference line at a specified lateral distance to the first circumference line. The optical beam device consists of a beam source for the generation of a light or laser beam and for the projection of the generated beam onto a point of the wheelset or its wheels to be measured and of a lens for the interception of the beam reflected by the irradiated wheel surface and for the transformation of the reflected beam into a electric signal which can then be sent to an evaluation system. A fan-shaped beam path is favored of which the projection represents a line on the railway track. The relevant devices and technologies in this respect are described in detail in EP 0 228 500 B2 and also in WO 2004/085957 A1.

The trough also has a covering with a recess in the area of the beam path. The recess, in turn, has a covering which can be opened during measurements. The trough is also connected to a supply of gaseous medium, in particular air, which generates overpressure within the trough. This prevents moisture or dirt from entering the interior of the trough and impairing the effectiveness of the optical beam devices.

At least the first section for rolling the wheelset into the measurement section consists of a track segment in the form of a track panel and, in this respect, does not vary considerably from the track panel of a normal railway track. The two rail segments of the first section are flanked by strips on their outer sides which project a few millimeters over above the respective rail heads at a slight constant slope in the area of the measurement section and pass into an auxiliary rail which bridges the measurement section.

The third section for rolling out the wheelset is designed in the same way as the first section for rolling in the wheelset, which means the two rail segments of this third section are also flanked by strips on the outer sides which project a few millimeters over the respective rail head at a slight continuous descent in the area of the measurement section. The strips are used to guide the wheelset gently, which means without a jolty transition, up onto the auxiliary rail and then down again. The wheelset is supported on the auxiliary rail only on a narrow width on the outside of the profile of its wheels, while the remaining profile, in particular the wheel flange, is exposed and can therefore be registered by the beam path of the corresponding optical beam equipment.

The first and third section of the measuring instrument are each between 2.5 and 5 m long, whereas the auxiliary rail stretches across a length of between 0.25 and 0.5 m. The measuring instrument can be run over by railway vehicles with wheel loads of up to 35 t at speeds of between 5 and 50 km/h. It can be run over equally in both directions of travel.

The trough which contains the optical beam equipment is positioned within a second trough at approximately the same distance between the outside wall of the first trough and the inside wall of the second trough all round. If necessary, intermediate walls or intermediate webs can also be provided inside the second trough in order to align the position of the first trough in relation to the measurement section of the measuring instrument. There are recesses along the bottom of the walls of the second trough in order to drain water and dirt. The second trough, in particular, rests on a flat plate which is mounted on the formation of the railway track or on a thin layer of lightweight concrete. The first trough rests on at least three flexible supports within the second trough which at the same time are height adjustable to allow the optical beam devices to be mounted vibration-free.

BRIEF DESCRIPTION OF THE DRAWINGS

The invention is described in detail with the following example.

The following views are illustrated at a reduced scale.

DESCRIPTION

Figure 1:
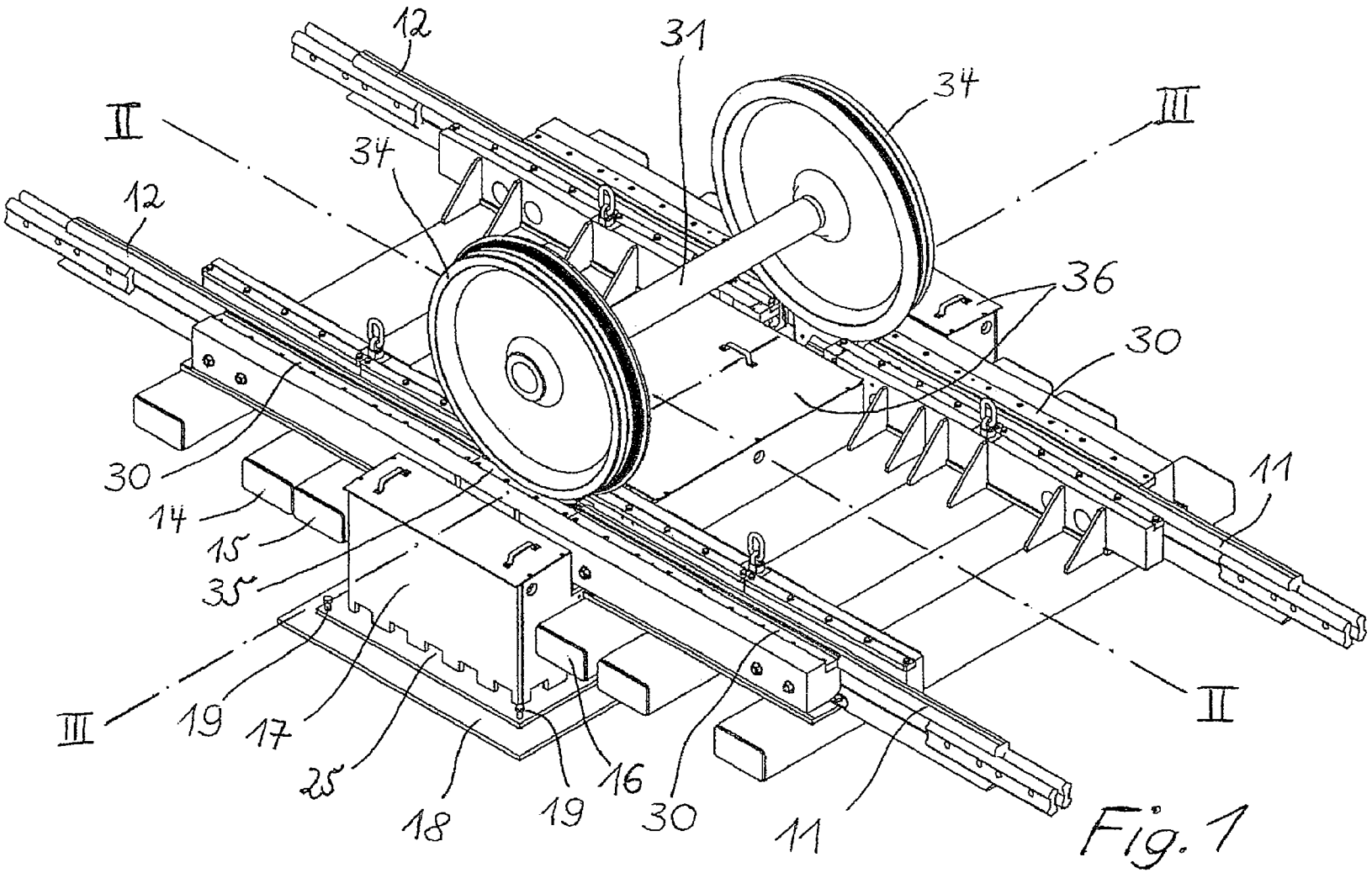
FIG. 1 is a perspective side view of the measuring instrument with a wheelset rolling over it.
Figure 2:
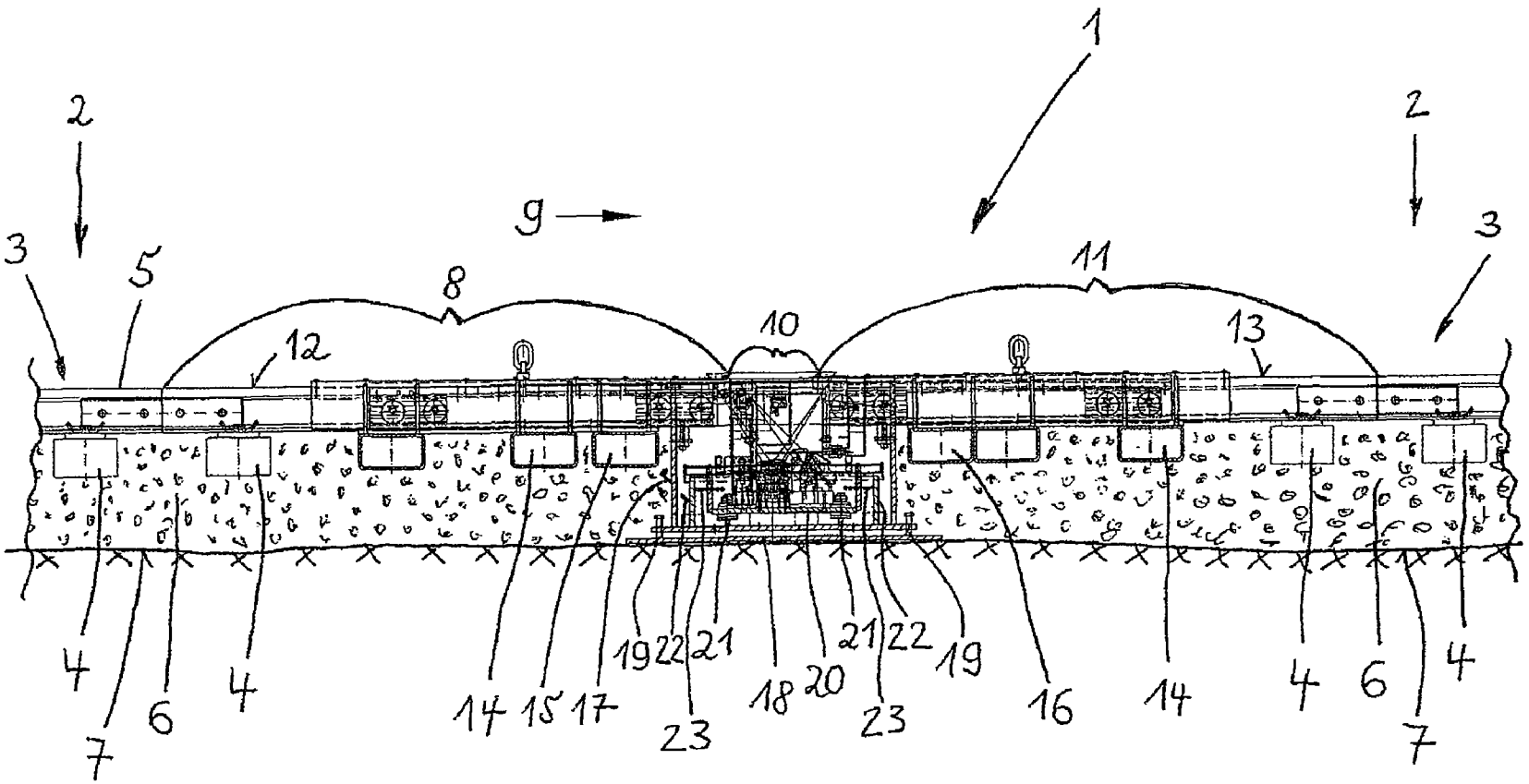
FIG. 2 is a longitudinal section through the measuring instrument along the line II-II of FIG. 1.

The measuring instrument (1) is positioned in the track panel (2) of a railway track (3). The thresholds (4) of the track panel (2) and the rails (5) fastened to them are illustrated in FIG. 2. The track panel (2) is embedded in the ballast (6) which is spread over a formation (7).

The measuring instrument (1) includes a first section (8) for rolling in a railway vehicle (not illustrated) in the direction of travel (9). A second section, referred to as measurement section (10), follows the first section (8) likewise in the direction of travel (9). The measurement section (10) is followed, in turn, in the direction of travel by the third section (11), referred to as the roll-out section. The first (8) and third section (11) are approximately of the same length. The sections (8 and 11) are bordered laterally by rails (12 and 13) which, in turn, are fastened to thresholds (14) embedded in the ballast (6). The first (8) and third section (11) are therefore mounted in the ballast (6) of the superstructure of the railway track (3) in the same way as the railway track (3) itself.

A threshold is recessed in the area of the measurement section (10). As a result, the measurement section (10) is bordered by the two thresholds (15 and 16) in the direction (9) of the railway track (3). A second trough (17), which is supported on the formation (7) by a plate (18), is positioned in the recess between the two thresholds (15 and 16). The plate (18) either lies directly on the formation (7) or is mounted on a thin layer of lightweight concrete (not illustrated). The second trough (17) can be aligned horizontally in relation to the plate (18) by means of set screws (19).

A first trough (20) is positioned within the second trough (17). The first trough (20) rests on flexible supports (21) in the second trough (17) which are vibration-free and can be adjusted horizontally to a low degree in terms of their height. Intermediate walls (22) between the first trough (20) and second trough (17) are intended to bring the first trough (20) in an exact lateral position to the measurement section (10) also in relation to the second trough (17). Lateral set screws (23) are intended for this purpose. They can be undone or removed after aligning the first trough (20) with the second trough (17), so that the first trough (20) no longer comes in contact with any other parts of the measuring instrument (1) apart from the flexible supports (21) on which it rests.

Figure 3:
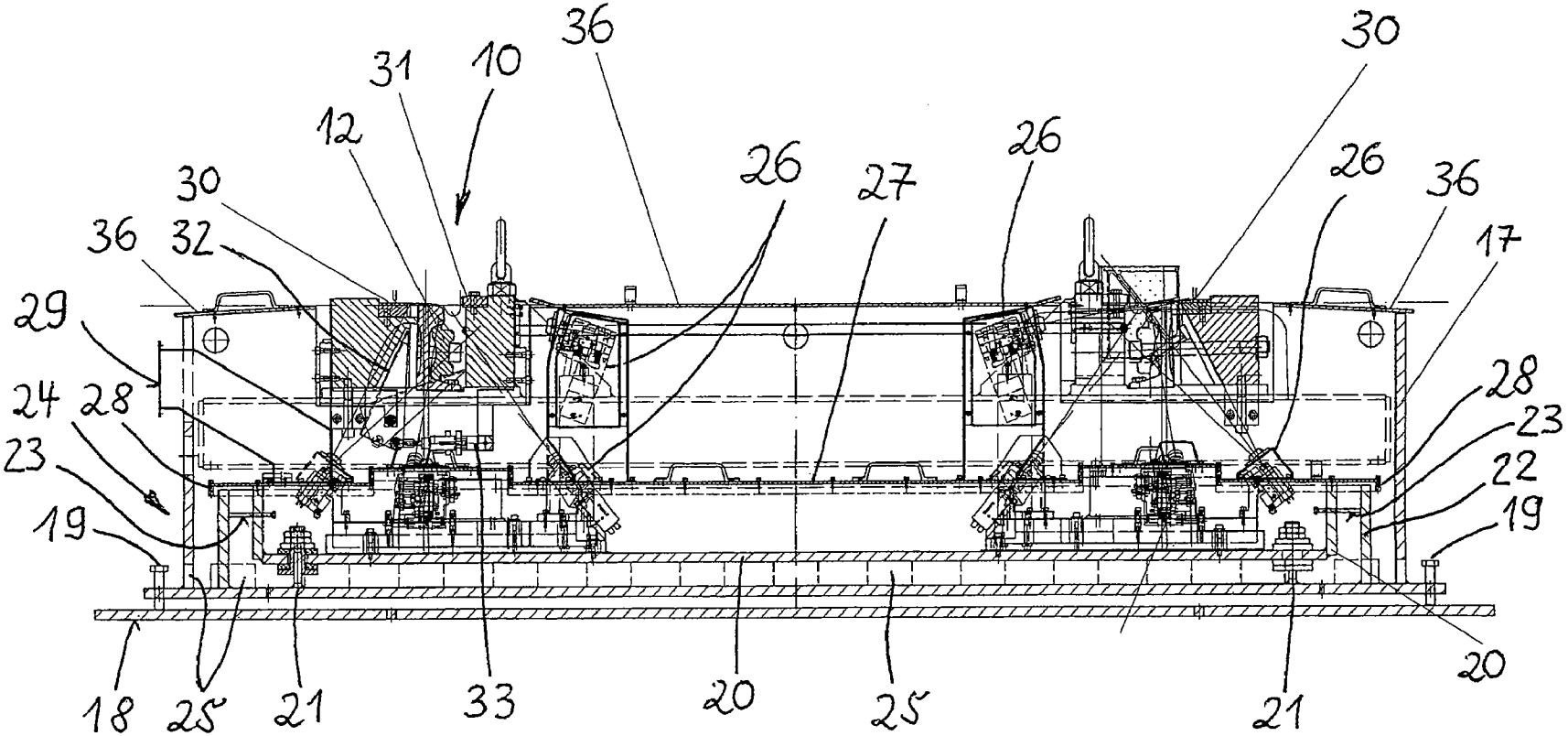
FIG. 3 is a cross section along the line III-III of FIG. 1.
Figure 4:
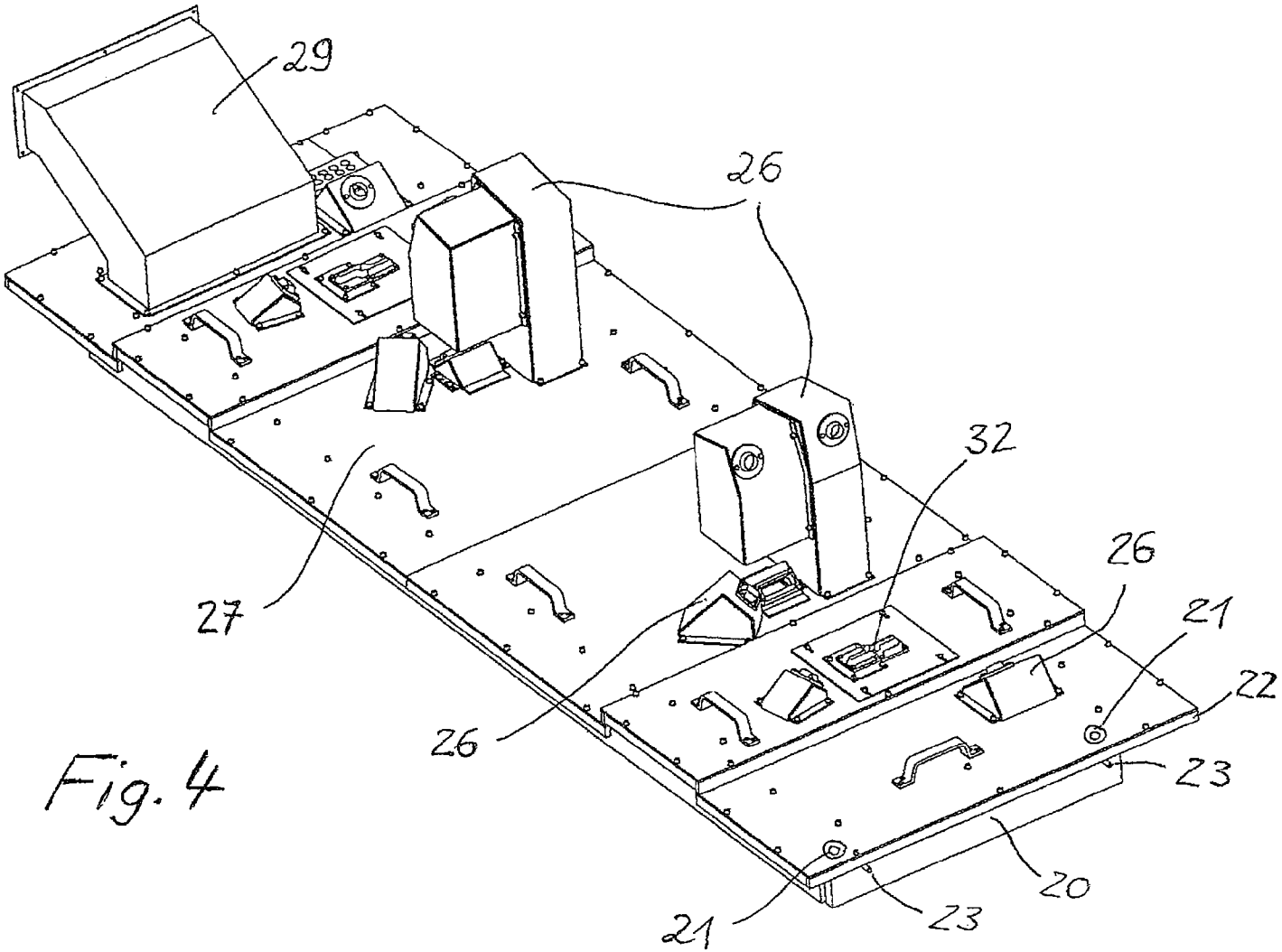
FIG. 4 is a diagram of the arrangement of the optical beam equipment.

This arrangement is illustrated in FIG. 3 from a different view. There are side openings (25) all round in the bottom of the second trough (17) which can be used to discharge dirt and rainwater if necessary. The optical beam equipment is positioned in the first trough (20) in accordance with the known standard of technology. This optical beam equipment (26) can be taken from FIG. 4 also in its opposite position.

The covering (27) of the first trough (20) which projects over the intermediate wall (22) protects the optical beam equipment (26) from dirt and damage. The side edges (28) of the covering (27) project over the intermediate wall (22), however the covering lies on the top edge of the first trough (20), not on top of the intermediate wall (22). A coupling (29), which is used to supply the first trough (20) with air from the outside, leads from the outside into the interior of the first trough (20). The first trough (20) is supplied with air at constant overpressure which is discharged below the side edges (28).

As illustrated in FIG. 3, the rail (12) of the first section (8) is flanked by a strip (30) on its outer side. The strip (30) is at a slight constant slope from the rail (5) to the measurement section (10) and slightly projects over the rail head of the rail (12) before the transition to a support rail (35). The wheels (34) of the wheelset (31) gently roll over the lateral strip (30) from the first section (8) onto the measurement section (10).

The measuring instrument (1) is covered by flaps (32) in the area of the measurement section (10) which open only shortly before a wheelset (31) rolls over it and then close again afterwards. A mechanism (33) is used to move the flaps (32). The entire measuring instrument (1) is closed by an upper overall covering (36).

REFERENCE DRAWING LIST

1 Measuring instrument
2 Track panel
3 Railway track
4 Threshold
5 Rail
6 Ballast
7 Formation
8 First section
9 Direction of travel
10 Measurement section
11 Third section
12 Rail
13 Rail
14 Threshold
15 Threshold
16 Threshold
17 Second trough
18 Plate
19 Set screw
20 First trough
21 Flexible support
22 Intermediate wall
23 Set screw
24 Bottom
25 Side opening
26 Optical beam equipment
27 Covering
28 Side edge
29 Coupling
30 Strip
31 Wheelset
32 Cap cover
33 Mechanism
34 Railway wheel
35 Support rail
36 Overall covering

The invention claimed is:

1. A measuring instrument, positioned in a track panel of a railway track, for determining actual condition of wheelsets and wheels of a railway vehicle passing by using several optical beam devices, with the measuring instrument featuring a first section for rolling in a wheelset under lateral guidance of the wheelset, a measurement section with an auxiliary rail for supporting the wheelset on the outer edges of its two wheels and a third section for rolling out the wheelset into the railway track, with the first and third section of the measuring instrument also designed as track panels and flexibly embedded in a ballast of the superstructure of the railway track and of which the optical beam devices are positioned beneath the measurement section and mounted vibration-free on a base plate on a formation of the railway track in a pre-determined position in relation to the measurement section of the measuring instrument with no contact to the other parts of the measuring instrument, with the base plate designed as first trough, circumferentially enclosed by side walls, with several coverings which each have a recess in the area of the beam path and can be opened during measurements, wherein a first trough is positioned within a second trough at an approximately even distances to walls all round.

2. The measuring instrument according to claim 1, wherein recesses along the bottom of the walls of the second trough are used to drain water and dirt.

3. The measuring instrument according to claim 2, wherein the second trough lies on a flat plate mounted directly on the formation of the railway track or on a thin layer of lightweight concrete.

4. The measuring instrument according to claim 1, wherein the first trough rests on at least three flexible supports within the second trough.

5. The measuring instrument according to claim 1, wherein the first trough is connected to a compressed air supply.

6. The measuring instrument according to claim 1, wherein at least the first section used to roll the wheel set into the measurement section includes a track segment of which two rail segments are flanked on their outer side by strips which project several millimeters over respective rail heads at a constant slight slope in the area of the measurements section and pass into an auxiliary rail which bridges the measurement section.

7. The measuring instrument according to claim 6, wherein the third section for rolling out the wheelset has the same design as the first section for rolling in the wheelset.

8. The measuring instrument according to claim 1, wherein the first and third sections each have a length of between 2.5 and 5 mm.

9. The measuring instrument according to claim 1, wherein the measurement section has a length of between 0.25 and 0.5 m.

10. The measuring instrument according to claim 1, wherein the measuring instrument can be run over by railway vehicles at speeds of between 5 and 50 km/h.

11. The measuring instrument according to claim 2, wherein the measuring instrument can be run over in both directions of the railway track.

* * * * *

UNITED STATES PATENT AND TRADEMARK OFFICE

CERTIFICATE OF CORRECTION

PATENT NO. : 7,952,729 B2
APPLICATION NO. : 12/302179
DATED : May 31, 2011
INVENTOR(S) : de la Riva et al.

It is certified that error appears in the above-identified patent and that said Letters Patent is hereby corrected as shown below:

In Claim 8, at column 6, lines 46-47, "2.5 and 5 mm" should read as --2.5 and 5 m--

Signed and Sealed this
Sixth Day of March, 2012

David J. Kappos

David J. Kappos
*Director of the United States Patent and Trademark Office*